US005881555A

United States Patent [19]

Jaeger

[11] Patent Number: 5,881,555

[45] Date of Patent: Mar. 16, 1999

[54] EXHAUST PRESSURE PULSATION CONTROL APPARATUS FOR MARINE PROPULSION SYSTEM

[75] Inventor: Matthew W. Jaeger, Stillwater, Okla.

[73] Assignee: Brunswick Corporation, Lake Forest, Ill.

[21] Appl. No.: 861,126

[22] Filed: May 21, 1997

[51] Int. Cl.[6] ..... F01N 3/04; B63H 21/32

[52] U.S. Cl. ..... 60/310; 440/89; 181/271

[58] Field of Search ..... 60/310, 324; 440/89; 181/260, 264, 270, 271

[56] References Cited

U.S. PATENT DOCUMENTS

| | | | |
|---|---|---|---|
| 1,048,435 | 12/1912 | Still et al. | 181/260 |
| 2,485,555 | 10/1949 | Bester | 181/260 |
| 3,130,541 | 4/1964 | Babbit | 60/310 |
| 3,166,895 | 1/1965 | Slayter | 60/299 |
| 4,055,231 | 10/1977 | Martinez | 181/264 |
| 4,326,374 | 4/1982 | Streb | 440/89 |
| 4,573,318 | 3/1986 | Entringer et al. | 60/310 |
| 4,609,068 | 9/1986 | Backlund | 181/226 |
| 4,643,272 | 2/1987 | Gaffrig | 181/260 |
| 4,781,021 | 11/1988 | Winberg | 60/310 |
| 4,845,945 | 7/1989 | Widner et al. | 60/310 |
| 4,966,253 | 10/1990 | Stephens et al. | 181/264 X |
| 5,740,670 | 4/1998 | Woods | 60/310 |
| 5,791,953 | 8/1998 | Gunderson et al. | 440/89 |

OTHER PUBLICATIONS

CP Slip–In Silencer II,Buyer's Guide, p. 109, Powerboat, Jun. 1995.

The Shotgun Exhaust Silencer, Buyer's Guide, p. 113, Powerboat, Jun. 1995.

Stainless Steel 4" Muffler Tip Inserts, Buyer's Guide, p. 114, Powerboat, Jun. 1995.

33% Glass Reinforced Polyphthalamide manufactured by Amoco, Inc.

Nylon 4,6 Manufacture by DSM, Inc.

*Primary Examiner*—John E. Ryznic

*Attorney, Agent, or Firm*—Andrus, Sceales, Starke & Sawall

[57] ABSTRACT

An improved exhaust pressure pulsation control apparatus for a marine propulsion system has a front ring, a reflector disk located downstream of the front ring, and a plurality of connecting members connecting the front ring to the reflector disk. Each connecting member has a concave outer edge to facilitate mounting the apparatus within an exhaust tube. A clamp outside of the exhaust tube clamps the exhaust tube against the concave outer edges of the connecting members to secure the apparatus longitudinally within the exhaust tube. The apparatus is preferably made of a fiberglass reinforced thermoplastic material, such as 33% fiberglass reinforced polythalamide or nylon 4,6, through an injection molding process.

15 Claims, 4 Drawing Sheets

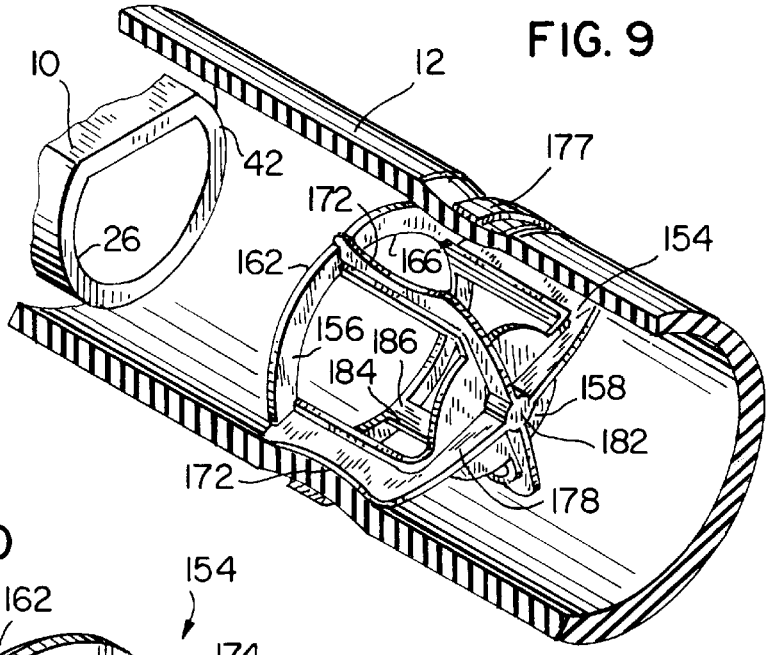
FIG. 9
FIG. 10
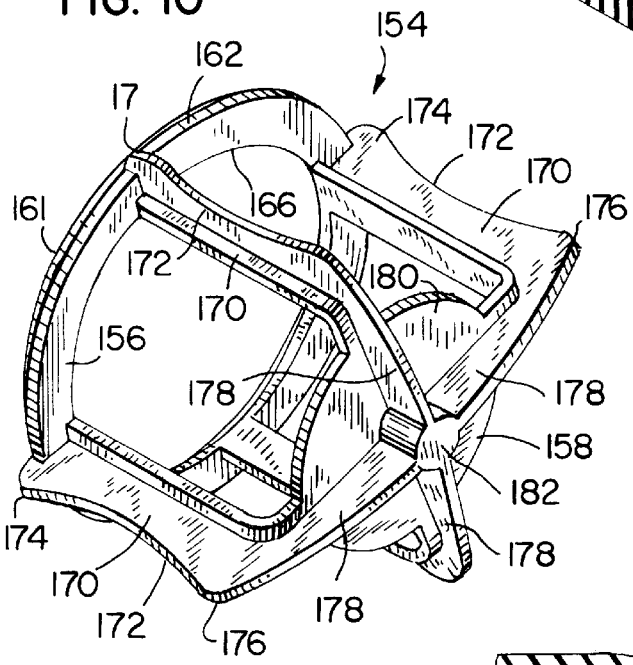
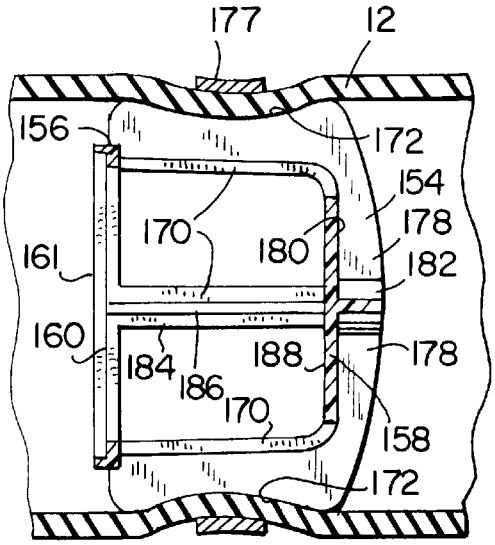
FIG. 11

EXHAUST PRESSURE PULSATION CONTROL APPARATUS FOR MARINE PROPULSION SYSTEM

FIELD OF THE INVENTION

The invention is an improved exhaust pressure pulsation control apparatus for a marine propulsion system. The invention is particularly useful for reducing water ingestion through an engine exhaust system back into the engine.

BACKGROUND OF THE INVENTION

In a typical inboard/outboard or inboard marine propulsion system, hot exhaust gases from engine cylinders discharge into a water jacketed exhaust manifold which directs the hot exhaust gases into a water jacketed exhaust elbow. The exhaust elbow normally has a generally vertical intake exhaust passage, and then bends around to a slightly downward sloping discharge exhaust passage. The hot exhaust gases flow into the exhaust elbow through the intake passage and exit the elbow through the exhaust discharge passage. Cooling water from the engine inputs the exhaust elbow water jacket from the same side as the exhaust intake and generally flows through the water jacket to the exhaust discharge where the coolant water is mixed with the hot exhaust gases. By mixing the coolant water with the exhaust gases, the exhaust gases are cooled. The mixture of exhaust gases and coolant water is then typically discharged through an exhaust bellows or exhaust tube and then through the transom, or the propeller torpedo, or the like.

It is sometimes desirable to discharge the mixture of cooled exhaust gases and spent coolant water through the transom of the boat above the surface of the water. Discharging below the water surface tends to create an exhaust back pressure which, under certain high performance conditions, can reduce the power output of the propulsion system. In high performance applications, it is also desirable to reduce the creation of exhaust back pressures during acceleration.

In systems where the exhaust tube passes through the transom of the boat to discharge the cooled exhaust gases and spent coolant water above the surface of the water (i.e. through-transom exhaust systems), water ingestion through the exhaust system back into the engine can be a significant problem. In through-transom exhaust systems, exhaust pressure pulsations due to reciprocating piston movement and valve overlap tend to suck water within the exhaust tube back into the engine. Water or moisture actually travels backwards into the interior of the exhaust passage within the elbow in a pulsating manner and eventually back into the engine. The pulsating water ingestion becomes more pronounced as engine size increases, especially in propulsion systems having little or no exhaust back pressure. This is typically true of high performance marine propulsion systems having through-transom exhaust systems.

Copending U.S. patent application Ser. No. 08/512,026, now U.S. Pat. No. 5,644,914, issued on Jul. 8, 1997, entitled "Exhaust Pressure Pulsation Control Apparatus for Marine Propulsion System" by Gregory B. Deavers, Loren T. Powers, and George E. Brown, assigned to the assignee of the present application and incorporated herein by reference, discloses an apparatus that eliminates exhaust pressure pulsation water ingestion without creating back pressure in the exhaust system. The apparatus disclosed in the above referenced copending patent application is especially useful in through-transom exhaust systems, or in other exhaust systems in which the cooled exhaust gases and spent coolant water are discharged above the surface of the water. The apparatus attenuates pressure pulsations in the exhaust system when placed at the proper location within the exhaust tube downstream of the exhaust elbow.

SUMMARY OF THE INVENTION

The invention is an improved exhaust pressure pulsation control apparatus that is easier to install, and easier and less expensive to manufacture than the apparatus disclosed in copending U.S. patent application Ser. No. 08/512,026, entitled "Exhaust Pressure Pulsation Control Apparatus for Marine Propulsion System" by Gregory B. Deavers et al., now U.S. Pat. No. 5,644,914 issued on Jul. 8, 1997.

More specifically, the improved exhaust pressure pulsation control apparatus comprises a front ring, a reflector disk located downstream of the front ring, and a plurality of connecting members connecting the reflector disk to the front ring. Each connecting member has a concave outer edge that is useful when mounting the apparatus within an exhaust tube. A clamp outside the exhaust tube clamps the exhaust tube against the concave outer edges of the connecting members to secure the apparatus at a fixed position longitudinally within the exhaust tube. The longitudinal position of the apparatus in the exhaust tube can be easily adjusted by loosening the clamp, moving the pulsation control apparatus within the exhaust tube, and retightening the clamp to secure the apparatus at the new location. This feature is particularly useful because in some applications the exhaust pressure pulsation control apparatus must be precisely located within the exhaust tube to be most effective.

In another aspect of the invention, the exhaust pressure pulsation control apparatus is made out of a fiberglass reinforced thermoplastic material, such as 33% fiberglass reinforced polythalamide or 33% fiberglass reinforced nylon 4,6. Such fiberglass reinforced thermoplastic materials are desirable because their use enables the entire apparatus to be manufactured through injection molding. The fiberglass reinforced thermoplastic material is essentially inert and inherently corrosion proof.

Most thermoplastic materials are not able to withstand the harsh environments within the exhaust tube. Normally during engine operation, spent cooling water is mixed with hot exhaust gases (e.g. 1100° F.) from the engine to lower the temperature of the hot exhaust gases. However, there are times when the flow of cooling water is interrupted and excessively hot exhaust gases are present in the exhaust tube. The exhaust pressure pulsation control apparatus must be able to withstand such high temperatures. It has been found that the above noted fiberglass reinforced thermoplastic materials are able to withstand such high temperatures, at least for relatively short periods of times.

In order to withstand the rigorous environment within the exhaust tube, the structure of the apparatus must be reinforced. The fiberglass reinforcement provides greater tensile strength and stiffness (Young's modulus). This is beneficial for supporting stresses in the apparatus, especially at the higher temperatures to which the apparatus is exposed. The preferred embodiment of the exhaust pressure pulsation control apparatus which is shown in FIGS. 9 through 11 is designed so that the complex shape required by reinforcement can be molded to that shape without secondary operations.

Other features and advantages of the invention may be apparent to those skilled in the art upon reviewing the following drawings and description thereof.

BRIEF DESCRIPTION OF THE DRAWINGS COPENDING PATENT APPLICATION

FIG. 1 is a view of a marine propulsion system having a through-transom exhaust discharge.

FIG. 2 is a perspective view of a part of the exhaust system shown in FIG. 1 having an exhaust pressure pulsation control apparatus in accordance with copending U.S. patent application Ser. No. 08/512,026, now U.S. Pat. No. 5,644,914.

Figure 5:
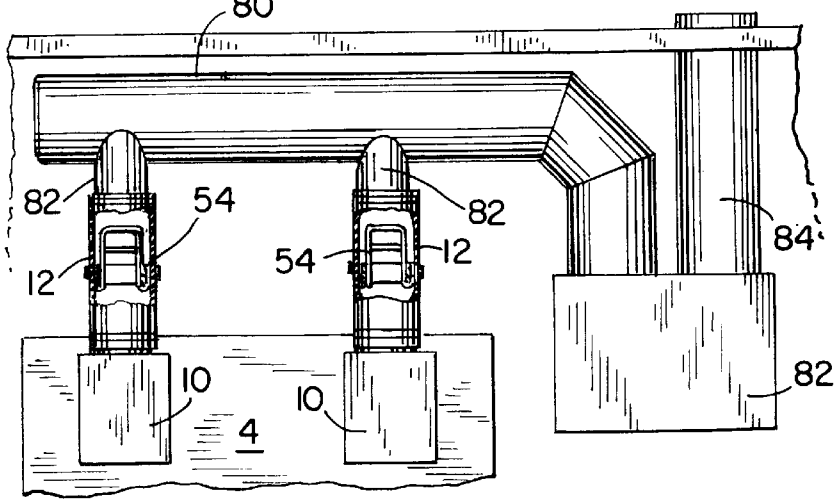
FIG. 5 PRIOR ART

FIG. 5 is a top view of a marine propulsion system having an exhaust system with an exhaust collector and an exhaust pressure pulsation control apparatus in accordance with copending U.S. patent application Ser. No. 08/512,026, now U.S. Pat. No. 5,644,914.

Figure 6:
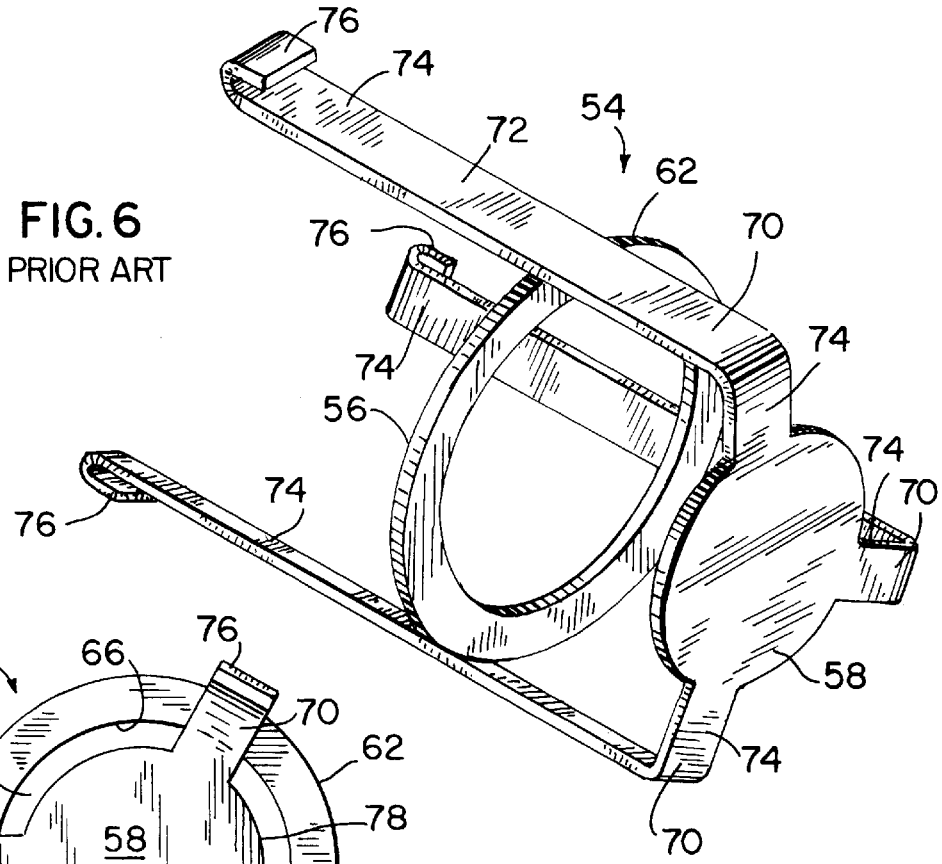
FIG. 6 PRIOR ART

FIG. 6 is a perspective view of the exhaust pressure pulsation control apparatus disclosed in U.S. patent application Ser. No. 08/512,026, now U.S. Pat. No. 5,644,914.

Figure 7:
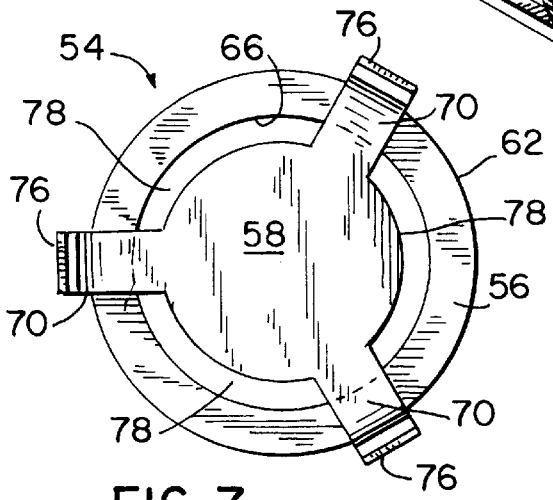
FIG. 7 PRIOR ART

FIG. 7 is an end view of the exhaust pressure pulsation control apparatus shown in FIG. 6.

Figure 8:
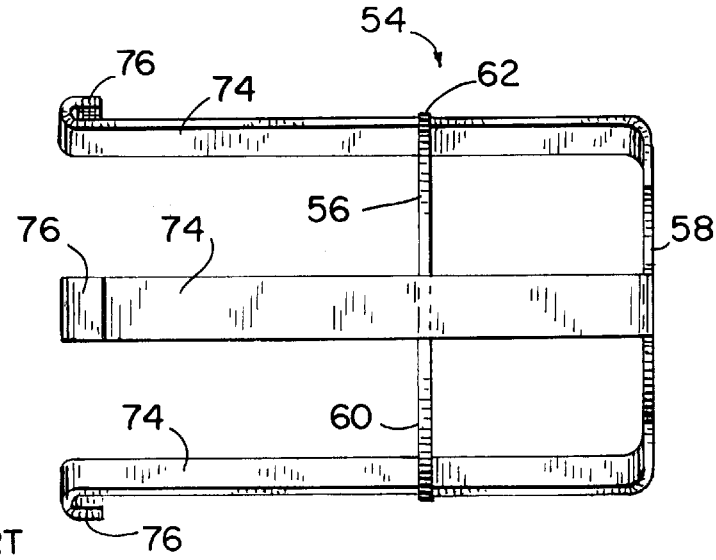
FIG. 8 PRIOR ART

FIG. 8 is a side elevational view of the exhaust pressure pulsation control apparatus shown in FIGS. 6 and 7.

PRESENT INVENTION

Figure 1:
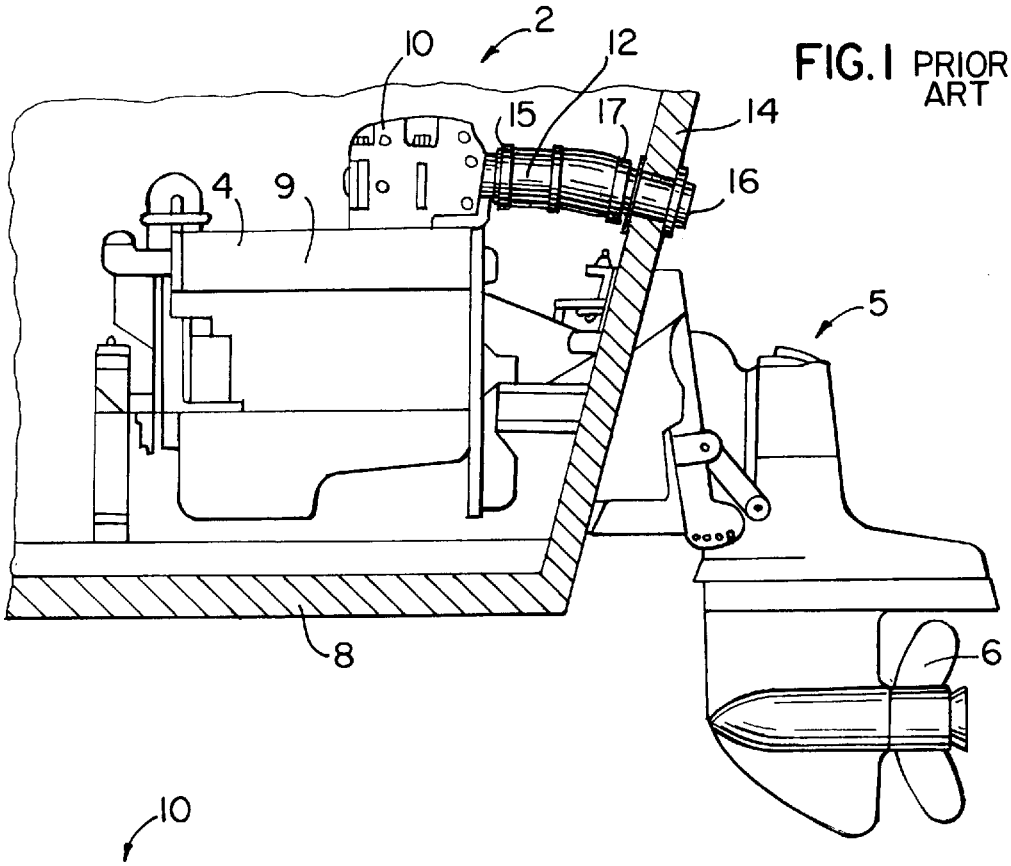
FIG. 1 PRIOR ART

FIG. 9 is a perspective view of part of the exhaust system shown in FIG. 1 having an exhaust pressure pulsation control apparatus in accordance with the invention.

FIG. 10 is a perspective view of an exhaust pressure pulsation control apparatus in accordance with the invention.

FIG. 11 is a side view showing an exhaust pressure control apparatus in accordance with the invention being installed within an exhaust tube.

DETAILED DESCRIPTION OF THE DRAWINGS COPENDING PATENT APPLICATION

FIGS. 1–8 show the exhaust pressure pulsation control apparatus 54 disclosed in copending U.S. patent application Ser. No. 08/512,026, filed on Aug. 7, 1995, entitled "Exhaust Pressure Pulsation Control Apparatus for a Marine Propulsion System" by Gregory B. Deavers, et al. filed on Aug. 7, 1995, now U.S. Pat. No. 5,644,914, issued on Jul. 8, 1997, assigned to assignee of the present application, and incorporated herein by reference. Like reference numerals are used herein where appropriate to facilitate understanding.

FIG. 1 is a side view of an inboard/outboard marine propulsion system 2 having an internal combustion engine 4, and an outdrive 5 having a propeller 6 for propelling the boat 8. The propulsion system 2 in FIG. 1 has a through-transom exhaust system. Hot exhaust gases from the engine cylinders discharge into two water jacketed exhaust manifolds 9: one on the left side and one on the right side. Each water jacketed exhaust manifold 9 directs the hot exhaust gases into a water jacketed exhaust elbow 10. In the exhaust elbow 10, the hot exhaust gases are mixed with coolant water from the engine and the mixture is then discharged through exhaust bellows tube 12 through the transom 14 into the atmosphere.

Each of the exhaust bellows tubes 12 is connected to the exhaust elbow 10 with a clamp 15 and to a transoms exhaust mount 16 with a clamp 17. Although not shown on FIG. 1, it may be desirable to provide a flapper over the exhaust discharge outlet of the transom exhaust mounts 16 to prevent water from backsplashing into the exhaust.

Figure 2:
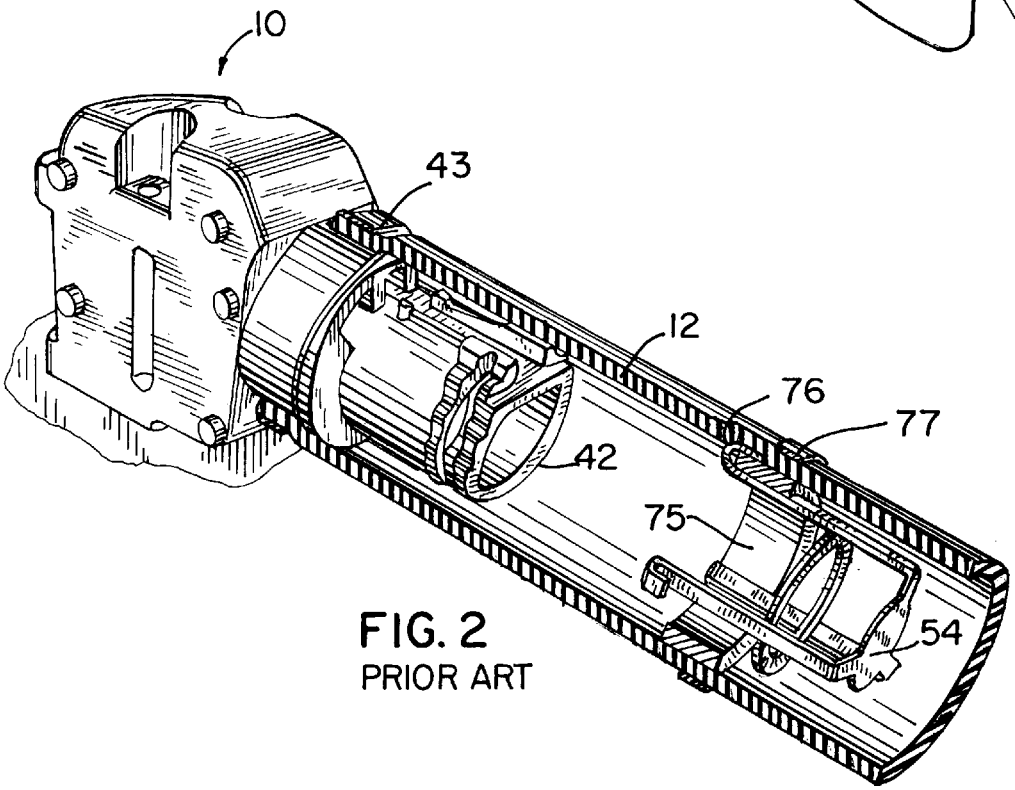
FIG. 2 PRIOR ART
Figure 3:
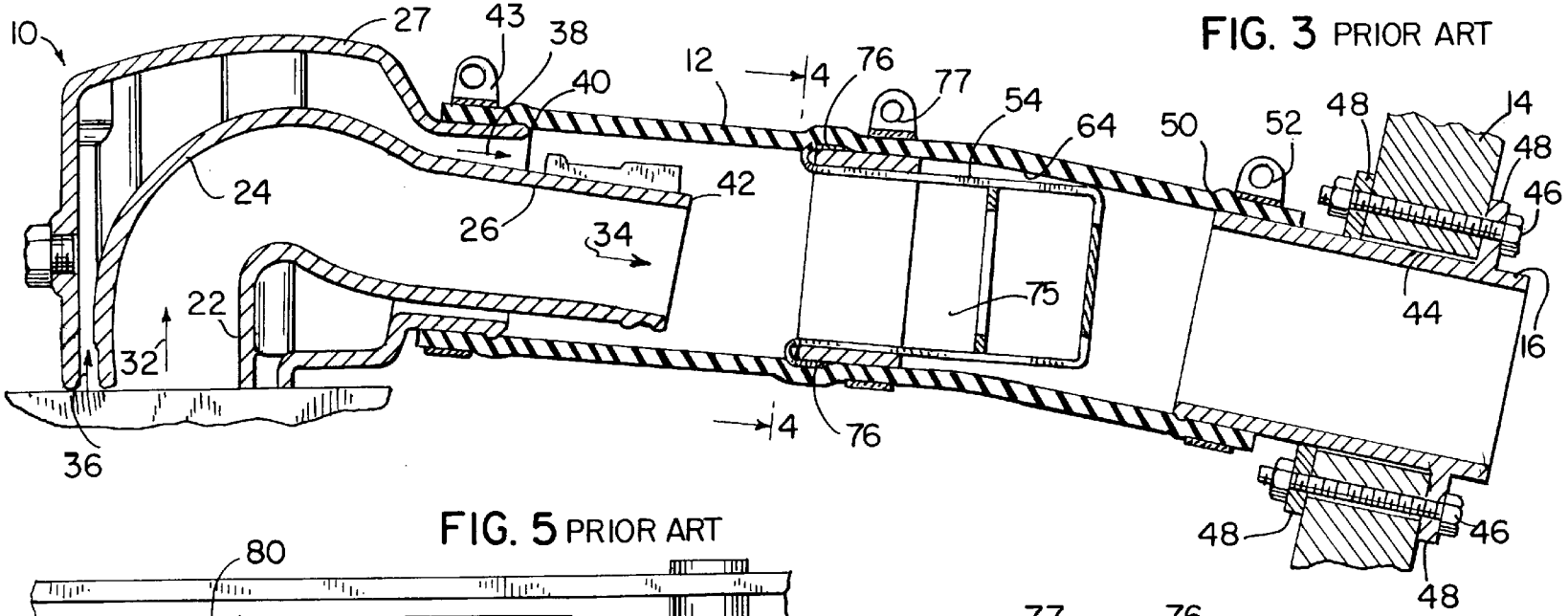
FIG. 3 PRIOR ART
FIG. 3 is a sectional view of the exhaust system of FIG. 2.
Figure 4:
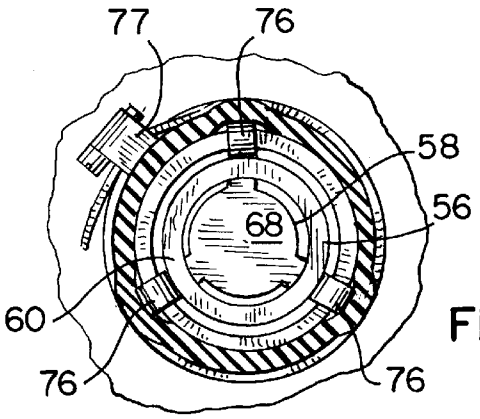
FIG. 4 PRIOR ART
FIG. 4 is a sectional view taken along line 4—4 in FIG. 3.

Referring now to FIGS. 2 and 3, the exhaust elbow 10 is similar to the exhaust elbow disclosed in U.S. Pat. No. 4,573,318 which is assigned to the assignee of the present patent application. The exhaust elbow 10 includes an intake exhaust passage 22 extending upwardly from the engine and communicating through a top bend 24 with a discharge exhaust passage 26. The discharge exhaust passage 26 extends slightly downward at about a 7° angle from horizontal. An outer water jacket 27 is around the exhaust passage 22, 24, 26. Exhaust flows from the engine manifold 9 upwardly as shown by arrow 32, around the bend 24, and is discharged from the exhaust elbow 10 in the direction shown by arrow 34. Coolant water flows from the engine 4 upwardly as shown at arrow 36. The coolant water exits the water jacket 27 as shown by arrow 38. The water jacket 27 terminates at end 40 upstream of the gas discharge end tip 42 of the discharge exhaust passage 26. Exhaust bellows tube 12 is connected by a band clamp 15 or the like around end 40 of the water jacket 27 and extends externally downstream from the water jacket 27 around discharge exhaust passage 26. The exhaust bellows tube 12 discharges the spent coolant water and water-cooled exhaust gases through the transom 14 of the boat.

The exhaust gases entering the exhaust elbow 10 in the direction of arrow 32 have a relatively high temperature (e.g. approximately 1100° F. at idle). When the exhaust gases exit the exhaust elbow 10 through the tip 42 of the exhaust discharge passage 26, the coolant water mixes with the hot exhaust gases, thereby cooling the exhaust gases (e.g. approximately to 150° F. at idle). Inasmuch as the exhaust bellows tube 12 is normally made of rubber, it is important that the exhaust gases entering the tube 12 be cooled.

The exhaust transom mount 16 is mounted through a hole 44 in the transom 14. The transom exhaust mount 16 is mounted to the transom 14 by attaching bolts 46 through mount flanges 48 and through the transom 14. The rear end 50 of the exhaust bellows tube 12 is mounted to the transom exhaust mount 16 with a clamp 17 or the like.

An exhaust pressure pulsation control apparatus 54 is located within the exhaust bellows tube 12. The exhaust pressure pulsation control apparatus 54 controls pressure pulsations in the exhaust system (i.e. the exhaust manifold 9, the exhaust elbow 10, the exhaust bellow tube 12 and the transom exhaust mount 16). Uncontrolled pressure pulsations can reduce engine 4 power output and can also induce water ingestion through the exhaust system back into the engine 4. Note that the apparatus 54 controls or attenuates pressure pulsations in the exhaust system without creating significant exhaust back pressure which can impair engine performance in terms of power output.

Referring to FIGS. 2 through 4 and 6 through 8, the exhaust pressure pulsation control apparatus 54 has a front ring 56 and a reflector disk 58 located downstream of the front ring 56. The front ring 56 shown in FIGS. 2 through 4 and 6 through 8 is a flat, circular ring having a front face 60, FIGS. 4 and 8, generally perpendicular to the exhaust tube 12. The front ring 56 has an outside circumferential edge 62, FIG. 7, which does not necessarily contact the inside circumferential surface 64, FIG. 3, of the exhaust tube 12. The reflector disk 58 shown in FIGS. 2 through 4 and 6 through 8 is a generally flat, circular disk having a front face 68, FIGS. 4 and 7, that is generally perpendicular to the exhaust tube 12. As shown best in FIGS. 4 and 7, the diameter across the inside circumferential edge 66 of the front ring 56 is preferably larger than the diameter across the reflector disk 58.

Three connecting members 70 connect the reflector disk 58 to the outside circumferential edge 62 of the front ring 56. Each connecting member 70 is preferably L-shaped, having a longitudinal portion 72 and a radial portion 74. The radial portion 74 attaches to the reflector disk 58.

The longitudinal portions 72 of each of the connecting members 70 extends longitudinally beyond the front ring 56 to serve as a mounting arm 73. In the copending patent application it was disclosed that the entire pressure pulsation control apparatus 54 could be made from a heat and corrosion resistant material such as stainless steel. It was also disclosed that the apparatus 54 could be coated (e.g. painting; E-coating; powder painting) or plated (e.g. nickel plate; chrome plate, etc.) to inhibit galvanic reactions between dissimilar materials (e.g. stainless/copper).

In accordance with the copending patent application, the apparatus 54 is mounted within the exhaust tube 12 using a retainer ring 75 inside of the exhaust tube 12 and clamp 77 located outside of the exhaust tube 12. Each of the mounting arms 73 has a mounting flange 76 that is outwardly curved.

The retainer ring 75 is made of a heat and corrosion resistant material, such as stainless steel. As shown best in FIGS. 3 and 4, the exhaust pressure pulsation control apparatus 54 is secured within the exhaust tube 12 by placing the mounting flanges 76 around the retainer ring 75 and clamping the exhaust tube 12 around the retainer ring 75 and the flanges 76 with clamp 77.

The apparatus 54 should be positioned in the exhaust tube 12 so that the reflector disk 54 is located at a distance from the outlet 42 of the exhaust elbow 10 sufficient to reduce turbulence in the exhaust tube 12 due to pressure pulsations in the exhaust flow.

When the mixture of coolant water and water cooled exhaust gases from the exhaust elbow 10 flow through the exhaust tube 12 to the atmosphere, a central cross sectional portion of the flow path of the mixture is obstructed by the front face 68 of the reflector disk 58. Flow through the exhaust tube 12 outside of the central cross sectional portion is obstructed by the front face 60 of the front ring 56. Obstructing the fluid flow through the apparatus 54 in this manner attenuates pressure pulsation in the exhaust system. The attenuation of pressure pulsations is accomplished by the apparatus 54 in part by diffusing the flow of exhaust through the tube 12, and in part by reflecting or tuning the exhaust flow within the exhaust tube.

As the mixture of coolant water and water cooled exhaust gases flows through the apparatus 54, the mixture flows past the front ring 56 and then around reflector disk 58 through the flow spaces 78, FIG. 7, between the front ring 56, the reflector disk 58, and the connecting members 70. The flow space 78 has a sufficient flow area so that the mixture of coolant water and water cooled exhaust passing through the apparatus 54 does not have a significant restriction over a full range of operating conditions. It can therefore be appreciated that the apparatus 54 can be used to attenuate exhaust pressure pulsations without creating excessive exhaust back pressure. The apparatus 54 thus reduces water ingestion and also increases engine power output.

FIG. 1 shows a through-transom exhaust system, however use of the exhaust pressure pulsation control apparatus 54 is not limited to use in through-transom exhaust systems. Referring to FIG. 5, the exhaust pressure pulsation control apparatus 54 is especially useful in an exhaust system having an exhaust collector 80. Exhaust and coolant water from each of the exhaust elbows 10 is discharged through the exhaust bellow tubes 12 into the exhaust collector 80 through collector ports 82. The exhaust and coolant water in the collector 80 flows to a water lift system 82 and then through a discharge tube 84 to be discharged to the atmosphere. In an exhaust system with an exhaust collector 80, FIG. 5, there can be a tendency to exacerbate exhaust pressure pulsations in the exhaust system located towards the water lift system 82. Inserting the exhaust pressure pulsation control apparatus 54 within the exhaust tubes 12 in such a system, FIG. 5, attenuates the pressure pulses in both of the exhaust tubes 12 and again reduces water ingestion without increasing exhaust back pressure.

PRESENT INVENTION

FIGS. 9–11 show an improved exhaust pressure pulsation control apparatus 154 in accordance with the invention. The exhaust pressure pulsation control apparatus 154 includes a front ring 156 and a reflector disk 158 located downstream of the front ring 156. It is preferred that the diameter across the reflector disk 158 be less than the diameter across the inner edge 166 of the front ring 156.

The exhaust pressure pulsation control apparatus 154 includes a plurality of connecting members 170 that connect the front ring 156 to the reflector disk 158. There are preferably four connecting members 170. Each of the connecting members 170 includes a concave outer edge 172. In the preferred embodiment of the invention, the length of the concave edge 172 for each connecting member 170 is about 2.1 inches long, and the curvature radius is roughly about 2.8 inches. Each concave edge 172 includes a front end 174 and a rear end 176 that extend radially outward beyond the outer edge 162 of the front ring 156. The front portion 174 and the rear portion 176 of the concave edges 172 should extend radially from the apparatus to an equal distance to promote proper alignment of the apparatus 154 within the exhaust tube 12. Because the front portion 174 and the rear portion 176 of the concave edges 172 extend radially outward beyond the outer edge 162 of the front ring 156, the outer edge 162 of the front ring 156 does not contact the inside surface of the exhaust tube 12 when the apparatus 154 is properly installed within the exhaust tube 12.

To install the apparatus 154 within the exhaust tube 12, the apparatus 154 is placed within the exhaust tube 12 at a desired location. A clamp 177 around the exhaust tube 12 clamps the exhaust tube 12 against the concave outer edges 172 of the connecting members 170 to secure the apparatus 154 longitudinally within the exhaust tube 12 at the desired location. The position of the apparatus 154 can be easily moved by loosening the clamp 177, repositioning the apparatus 154 within the exhaust tube 12, and retightening the clamp 177 around the exhaust tube 12 against the concave outer edges 172 of the connecting members 170 of the apparatus 154.

In accordance with the invention, it is preferred that the apparatus 154 be made of a fiberglass reinforced thermoplastic material, such as 33% fiberglass reinforced polythalamide or fiberglass reinforced nylon 4,6, using an injection molding process. These materials have been found to withstand the rigorous environment within the exhaust tube 12. The fiberglass reinforced thermoplastic apparatus 154 includes a strength rib 161 that extends perpendicularly forward of the front surface 160 of the front ring 156 around the entire circumference of the front ring 156. The rib 161 preferably extends forward of the front ring 156 about 0.1 to 0.2 inches.

The fiberglass reinforced thermoplastic apparatus 154 also preferably includes a plurality of radially extending strength walls 178 supporting a rear surface 180 of the reflector disk 158. East strength wall 178 extends perpendicularly rearward from the rear surface 180 of the reflector disk 158 preferably about 0.4 to 0.5 inches. As shown in FIGS. 9 and 10, it is preferred that each radially extending strength wall 178 be coextensive with one of the connecting members 170. The geometry of the apparatus 154, including the use of four symmetrically located connecting members 170, and reinforcement walls which extend perpendicularly and coextensive from various surfaces of the apparatus 154, allow the manufacturer of a fiberglass reinforced thermoplastic apparatus 154 using a simplified injection molding process. With the design, the apparatus can be fully fabricated via injection molding without the need for further machining, etc. The radially extending strength walls 178 intersect at a hub 182. The hub 182 is preferably cylindrical and coextensive with the rear surface 180 of the reflector disk 158. It is preferred that the hub 182 contain an evacuated inner chamber that extends through the reflector disk 158. The evacuated inner chamber is not shown explicitly in the drawings. The evacuated inner chamber is preferably cylindrical and coaxial with the outer surface of the hub 182. It is also preferred that an inner surface 184 of the connecting members include a dished portion 186 corresponding to the outwardly extending concave edges 172. Further, such dished portions are desirable on the inner surface 188 of the reflector disk 158 at locations corresponding to the radially extending strength walls 178. The evacuated inner chamber in the hub 182, as well as the dished portions, enable the walls of the apparatus 154 to have relatively constant thickness, thereby minimizing residual stress in the port after completion of the ejection molding process.

Various modifications, alternatives or equivalents to the invention may be apparent to those skilled in the art. Such modifications, alternative or equivalents should be considered to be within the scope of the following claims.

I claim:

1. In a marine propulsion system having an internal combustion engine, an exhaust tube receiving a flow of water and water cooled exhaust from the engine, an exhaust pressure pulsation control apparatus located within the exhaust tube to produce water ingestion from the exhaust tube upstream into the engine, an improved exhaust pressure pulsation control apparatus comprising:

a front ring;

a reflector disk located downstream of the front ring; and a plurality of connecting members connecting the reflector disk to the front ring, each connecting member having a concave outer edge;

wherein a clamp outside the exhaust tube clamps the exhaust tube against the concave outer edges of the connecting members to secure the apparatus longitudinally within the exhaust tube so that the mixture of water and water cooled exhaust passing through the exhaust also passes through the apparatus.

2. An improved exhaust pressure pulsation control apparatus as recited in claim 1 wherein the entire apparatus is made of a fiberglass reinforced thermoplastic material.

3. An improved exhaust pressure pulsation control apparatus as recited in claim 2 wherein the glass reinforced thermoplastic material is a fiberglass reinforced polythalamide.

4. An improved exhaust pressure pulsation control apparatus as recited in claim 3 wherein the glass reinforced polythalamide is 33% fiberglass reinforced polythalamide.

5. An improved exhaust pressure pulsation control apparatus as recited in claim 2 wherein the fiberglass reinforced thermoplastic material is nylon 4,6.

6. An improved exhaust pressure pulsation control apparatus as recited in claim 2 wherein a front surface of the front ring is generally parallel to the reflector disk and the front ring contains a rib extending perpendicularly from the front surface continuously around the front ring.

7. An improved exhaust pressure pulsation control apparatus as recited in claim 2 further comprising radially extending strength walls supporting a rear surface of the reflector disk.

8. An improved exhaust pressure pulsation control apparatus as recited in claim 7 wherein each connecting member is co-extensive with one of the radially extending strength walls.

9. An improved exhaust pressure pulsation control apparatus as recited in claim 7 wherein the radially extending strength walls intersect at a hub, and the hub contains an evacuated inner chamber that extends through the reflector disk.

10. An improved exhaust pressure pulsation control apparatus as recited in claim 7 wherein each connecting member has an inside surface that is dished, and the reflector plate has a front surface that is dished at locations corresponding to the radially extending strength walls.

11. An improved exhaust pressure pulsation control apparatus as recited in claim 1 wherein the apparatus includes four connecting members.

12. In a marine propulsion system having an internal combustion engine, an exhaust tube receiving a flow of water and water cooled exhaust from the engine, an, exhaust pressure pulsation control apparatus located within the exhaust tube to reduce water ingestion from the exhaust tube upstream into the engine, an improved exhaust pressure pulsation control apparatus comprising:

a front ring;

a reflector disk located downstream of the front ring; and a plurality of connecting members connecting the reflective disk to the front ring, each connecting member having a concave outer edge;

wherein the entire apparatus is made of a fiberglass reinforced thermoplastic material and the apparatus is mounted longitudinally within an exhaust tube so that a mixture of water and water cooled exhaust passing through the exhaust also passes through the apparatus.

13. An improved exhaust pressure pulsation control apparatus as recited in claim 12 wherein the fiberglass reinforced thermoplastic material is a glass reinforced polythalamide.

14. An improved exhaust pressure pulsation control apparatus as recited in claim 13 wherein the fiberglass reinforced polythalamide is 33% glass reinforced polythalamide.

15. An improved exhaust pressure pulsation control apparatus as recited in claim 13 wherein the fiberglass reinforced thermoplastic material is nylon 4,6.

* * * * *